United States Patent [19]

Matsufuji et al.

[11] Patent Number: 4,475,946

[45] Date of Patent: Oct. 9, 1984

[54] FERROMAGNETIC METAL PARTICLES OF IRON ALLOYED WITH TI, V, CR, MN, CO, NI, CU, ZN, SI, P, MO, SN, SB AND AG COATED WITH MONO- OR DIALKOXYSILANES

[75] Inventors: Akihiro Matsufuji; Shizuo Umemura; Masashi Aonuma; Hajime Miyatsuka; Tatsuji Kitamoto, all of Kanagawa, Japan

[73] Assignee: Fuji Photo Film Co., Ltd., Kanagawa, Japan

[21] Appl. No.: 530,436

[22] Filed: Sep. 8, 1983

[30] Foreign Application Priority Data

Sep. 8, 1982 [JP] Japan ..... 57-156405

[51] Int. Cl.[3] ..... C22B 5/12; C22C 1/04

[52] U.S. Cl. ..... 75/0.5 AA; 75/0.5 BA; 75/0.5 R; 75/251; 148/105

[58] Field of Search ..... 75/251, 0.5 AA, 0.5 BA; 148/105

[56] References Cited

U.S. PATENT DOCUMENTS

| | | | |
|---|---|---|---|
| 4,133,677 | 1/1979 | Matsui et al. | 148/105 |
| 4,309,459 | 1/1982 | Tokuoka | 148/105 |
| 4,390,361 | 6/1983 | Sueyoshi et al. | 148/105 |
| 4,406,694 | 9/1983 | Mishima et al. | 148/105 |

FOREIGN PATENT DOCUMENTS

| | | | |
|---|---|---|---|
| 55-39660 | 3/1980 | Japan | 148/105 |
| 55-39661 | 3/1980 | Japan | 148/105 |
| 57-39508 | 3/1982 | Japan | 148/105 |
| 863178 | 9/1981 | U.S.S.R. | 148/105 |

*Primary Examiner*—Veronica O'Keefe

*Attorney, Agent, or Firm*—Sughrue, Mion, Zinn, Macpeak & Seas

[57] ABSTRACT

Ferromagnetic metal particles are disclosed, which have a silane compound on the surface thereof. The silane compound is represented by the formula:

$$R_n—Si—(OR')_{4-n}$$

wherein R and R' each represent an alkyl group and n represents 2 or 3. The ferromagnetic metal particles have excellent oxidation stability and corrosion resistance. Furthermore, the ferromagnetic metal particles have good dispersibility within a binder when used in connection with producing a magnetic recording medium.

7 Claims, No Drawings

FERROMAGNETIC METAL PARTICLES OF IRON ALLOYED WITH TI, V, CR, MN, CO, NI, CU, ZN, SI, P, MO, SN, SB AND AG COATED WITH MONO- OR DIALKOXYSILANES

FIELD OF THE INVENTION

The present invention relates to ferromagnetic metal particles suitable for use in a magnetic recording medium.

BACKGROUND OF THE INVENTION

Magnetic recording media using ferromagnetic metal particles which have high saturation magnetization (os) and high coercive force (Hc) have been studied and developed for the purpose of improving the recording density and improving the reproduction output.

Although the ferromagnetic metal particles have excellent magnetic characteristics, they are difficult to disperse because of their high saturation magnetization and large interaction between particles, and their dispersion stability is not so good. Further, they have a problem in chemical stability and are easily oxidized. Therefore, magnetic recording media using the metal particles can easily develop problems relating to stability with the passage of time. Particularly, when a process which comprises wetting a magnetic recording medium and thereafter drying it is repeated, precipitates are formed on the surface thereof which damages the uniformity and flatness of the surface. Consequently, not only does the output obtained from the magnetic recording medium vary or the drop-out increase, but neither normal recording or reproduction can be carried out.

Hitherto, surface treatment of ferromagnetic metal particles with trialkoxysilane compounds such as vinyltriethoxysilane, γ-methacryloxypropyltrimethoxysilane, glycidyloxypropyltrimethoxysilane and methyltrimethoxysilane have been known, as described in Japanese Patent Publication No. 4803/80. However, the thus treated metal particles do not have sufficient dispersiblity, oxidation stability and corrosion resistance.

SUMMARY OF THE INVENTION

An object of the present invention is to provide ferromagnetic metal particles having excellent oxidation stability and excellent corrosion resistance. Another object of the present invention is to provide ferromagnetic particles having good dispersibility.

As a result of many earnest studies in order to attain the above described objects, the present inventors have found that the oxidation stability, the corrosion resistance and the dispersibility are remarkably improved when the ferromagnetic metal particles are subjected to surface treatment with a silane compound represented by the following general formula.

$$R_n—Si—(OR')_{4-n}$$

wherein R and R' each represents an alkyl group and n represents 2 or 3.

DETAILED DESCRIPTION OF THE INVENTION

In the general formula, R and R' may be the same or different and each represents an alkyl group, preferably having 1 to 20 carbon atoms, more preferably 1 to 5 carbon atoms, most preferably 1 to 2 carbon atoms, such as a methyl group, an ethyl group, a propyl group, a butyl group, a hexyl group, an octyl group, a decyl group, a lauryl group and a stearyl group. The alkyl group may be substituted with a substituent such as a halogen atom. Preferred examples of the silane compound represented by the general formula include dimethyldimethoxysilane, trimethylmethoxysilane, dimethyldiethoxysilane, trimethylethoxysilane, diethyldiethoxysilane, triethylethoxysilane, bis-(2-chloroethyl)-dimethoxysilane and bis-(2-chloroethyl)dimethoxysilane. Of these, dimethyldimethoxysilane, dimethyldiethoxysilane and diethyldiethoxysilane are particularly preferred. Ferromagnetic metal particles surface-treated with the silane compounds used in the present invention (i.e., mono- or dialkoxysilanes) are superior in dispersibility and corrosion resistance to those treated with trialkoxysilanes, as shown in Examples described later. Though it is not clear why the mono- or dialkoxysilanes of the present invention provide the excellent results, it is believed that the mono- or dialkoxysilanes are effectively deposited on the surface of ferromagnetic metal particles as compared to trialkoxysilanes.

Examples of the ferromagnetic metal particles used in the present invention include an iron powder and alloy powders composed of iron and other metals (for example, Ti, V, Cr, Mn, Co, Ni, Cu, Zn, Si, P, Mo, Sn, Sb and Ag). The ferromagnetic metal particles having a specific surface area of 30 $m^2/g$ or more are preferably used in connection with the present invention. These ferromagnetic metal particles can be produced by the known processes as follows:

(1) an organic acid salt of ferromagnetic metal is hydrolyzed and then reduced with a reducing gas (see Japanese Patent Publication Nos. 11412/61, 22230/61, 14809/63, 3807/64, 8026/65, 8027/65, 15167/65, 12096/66, 24032/67, 3221/68, 22394/68, 29268/68, 4471/69, 27942/69, 38755/71, 4286/72, 38417/72, 41158/72 and 29280/73, Japanese patent Application (OPI) No. 38523/72 (the term "OPI" as used herein refers to a "published unexamined Japanese patent application"), and U.S. Pat. Nos. 3,186,829 and 3,190,748);

(2) an acicular oxyhydroxide of a ferromagnetic metal, an acicular oxyhydroxide of a ferromatnetic metal and another metal, or acucular iron oxide derived from these oxyhydroxides is reduced (see Japanese Patent Publication Nos. 3862/60, 11520/62, 20335/64, 20939/64, 24833/71, 29706/72, 39477/72, 24952/73 and 7313/74, Japanese Patent Application (OPI) Nos. 7153/71, 38523/72, 79153/73, 82395/73 and 97738/74, and U.S. Pat. Nos. 3,598,568, 3,634,063, 3,607,219, 3,607,220 and 3,702,270);

(3) a ferromagnetic metal is vaporized in a low-pressure inert gas (see Japanese Patent Publication Nos. 25620/71, 4131/74, 27718/72, 15320/74 and 18160/74 and Japanese Patent Application (OPI) Nos. 25662/73, 25663/73, 25664/73, 25665/73, 31166/73, 55400/73 and 81092/73);

(4) a metal carbonyl compound is thermally decomposed (see Japanese Patent Publication Nos. 1004/64, 3415/65, 16968/70 and 26799/74 and U.S. Pat. Nos. 2,983,997, 3,172,776, 3,200,007 and 3,228,882);

(5) particles of a ferromagnetic metal are electrodeposited on a mercury cathode from which the particles are then separated (see Japanese Patent Publication Nos. 12910/60, 3860/61, 5513/61, 787/64, 15525/64 and 8123/65, and U.S. Pat. Nos. 3,262,812, 3,198,717 and 3,156,650); and (6) a metal salt capable of forming a ferromagnetic material in aqueous solution is reduced with a reducing material (e.g., borohydride compound, hypophosphite or hydrazine) to form ferromagnetic particles (see Japanese Patent Publication Nos. 20520/63, 26555/63, 20116/68, 9869/70, 14934/70, 7820/72, 16052/72 and 41718/72, Japanese Patent Application (OPI) Nos. 1363/72, 42252/72, 42253/72, 44194/73, 79754/73 and 82396/73, U.S. Pat. Nos. 3,607,218, 3,756,866, 3,206,338, 3,494,760, 3,535,104, 3567,525, 3,661,556, 3,663,318, 3,669,643, 3,672,867 and 3,726,664 and Japanese Patent Application Nos. 91498/73, 92720,73, 106901/74 and 134467/74).

The ferromagnetic metal particles prepared by the method (2) wherein an acicular oxyhydroxide or acicular iron oxide is reduced, the method (3) wherein a ferromagnetic metal is vaporized in an inert gas and the method (6) wherein a metal salt is reduced in aqueous solution are particularly preferred because they can be manufactured easily on an industrial scale and have good characteristics. The resulting ferromagnetic metal particles may be provided with an oxide coating to improve their chemical stability.

In order to carry out the surface treatment with the silane compound, it is preferred to use a process which comprises dispersing ferromagnetic metal particles in a solution dissolving the silane compound in an organic solvent such as alcohols, ketones, esters, aliphatic hydrocarbons or aromatic hydrocarbons, etc. or water and thereafter removing the solvent. The concentration of the silane compound in the solution is not particularly limited, but generally from 1 to 20 wt%.

Oxidation or corrosion of the ferromagnetic metal particles becomes remarkably and the saturation magnetization decreases as the particle size decreases, since the specific surface area of the particles increases. However, when the surface treatment of the present invention is performed just after production of the ferromagnetic metal particles, i.e., before the particles contact with air or oxygen, the surface-treated particles can be taken out into air without the decrease in saturation magnetization. This is another effect of the present invention.

The amount of the silane compound with which the surface of the ferromagnetic metal powder is coated is preferred to be in a range of 0.1 to 20 wt%, preferably 0.5 to 5 wt%, based on teh ferromagnetic metal powder.

The thus surface-treated ferromagnetic metal particles are used in a conventional manner to produce a magnetic recording medium such as a magnetic tape or sheet. For example, the surface-treated ferromagnetic metal particles is blended with conventional binders, additives and solvents and dispersed by a conventional method. The resulting dispersion is applied to a non-magnetic base to produce a magnetic recording medium. The binders, additives, solvents and non-magnetic base and the process for producing the magnetic recording medium are described in Japanese Patent Publication No. 26890/81 and U.S. Pat. No. 4,135,016 herein incorporated by reference.

In the following, the present invention is illustrated in detail with reference to examples. However, the scope of the invention is not limited to these examples. In the examples, the term "part" means "part by weight".

EXAMPLE 1 needle-like α-FeOOH (length: 0.6 μm, acicular ratio: 20) containing 5 wt% of Ni which was sufficiently washed with water was heated to 500° C. for 2 hours in air to obtain an $\alpha$-$Fe_2O_3$ powder. Thereafter, it was reduced at 380° C. for 6 hours in a $H_2$ stream to obtain a Ni-containing α-Fe powder. This powder was immersed in toluene containing 2 wt% of dimethyldiethoxysilane based on the weight of magnetic powder immersed. After being dispersed with stirring, it was filtered out and dried at 40° C. in air to remove toluene. Thus, a Ni-containing α-Fe powder was obtained (Sample M-1).

COMPARATIVE EXAMPLE 1

The same procedure as in Example 1 was repeated to obtain a Ni-containing α-Fe powder, except that vinyltriethoxysilane was used instead of dimethyldiethoxysilane (Sample R-1).

COMPARATIVE EXAMPLE 2

The same prodedure as in Example 1 was repeated to obtain a Ni-containing α-Fe powder, except that toluene containing no dimethyldiethoxysilane was used (Sample R-2).

The magnetostatic characteristics of α-Fe powders obtained in Example 1 and Comparative Examples 1 and 2, those after being allowed to stand under an atmosphere at a temperature of 60° C. and a humidity of 90% RH for 1 week and those after immersing in a 3 wt% aqueous solution of common salt and drying were repeated three times, are shown in Table 1.

TABLE 1

| Sample | Magnetostatic Characteristic (Hm = 10 KOe) | | Magnetostatic Characteristic after allowed to stand at 60° C., 90% RH for 1 week | | Magnetostatic Characteristic after immersed in solution of common salt | |
|---|---|---|---|---|---|---|
| | Hc(Oe) | σs(emu/g) | Hc(Oe) | σs(emu/g) | Hc(Oe) | σs(emu/g) |
| M-1 (Example 1) | 1250 | 148 | 1240 | 135 | 1200 | 110 |
| R-1 (Comparative Example 1) | 1260 | 142 | 1240 | 125 | 1200 | 85 |
| R-2 (Comparative Example 2) | 1300 | 134 | 1250 | 110 | 1210 | 65 |

EXAMPLE 2

| | |
|---|---|
| α-Fe powder (M-1) | 300 parts |
| Vinyl chloride-vinyl acetate copolymer ("VMCH" produced by U.C.C.) | 30 parts |
| Polyurethane resin ("Esten 5701" produced by Goodrich Co.) | 20 parts |

TABLE 1-continued

| | |
|---|---|
| Dimethyl polysiloxane (Degree of polymerization: about 60) | 6 parts |
| Buthyl acetate | 600 parts |
| Methyl ethyl ketone | 300 parts |

The above described composition was sufficiently dispersed by blending in a ball mill. After dispersion, a 75 wt% solution containing 25 parts of triisocyanate compound ("Desmodur L-75" produced by Bayer A.G.) in ethyl acetate was added, and the mixture was dispersed by high rate shearing for 1 hour to prepare a magnetic coating composition.

The resulting coating composition was coated on a polyester film in a dry thickness of 4 μm, and magnetic orientation was carried out. After being dried, surface treatment was carried out, and the film was cut in a predetermined width to obtain a magnetic tape.

COMPARATIVE EXAMPLE 3

The same procedure as in Example 2 was repeated to obtain a magnetic tape, except that the α-Fe powder (R-1) was used instead of the α-Fe powder (M-1).

COMPARATIVE EXAMPLE 4

The same procedure as in Example 2 was repeated to obtain a magnetic tape, except that the α-Fe powder (R-2) was used instead of the α-Fe powder (M-1).

The magnetostatic characteristic of the magnetic tapes obtained in Example 2 and Comparative Examples 3 and 4 and the reduction rate of saturation flux density after being allowed to stand in an atmosphere at 60° C. and 90% RH for 1 week are shown in Table 2.

TABLE 2

Magnetostatic Characteristic

| | (Hm = 10 KOe) | | | Reduction Rate |
|---|---|---|---|---|
| | Hc | Bm | Squareness Ratio | of Saturation Flux Density (%) |
| Example 2 | 1150 | 3300 | 0.79 | 2 |
| Comparative Example 3 | 1140 | 3200 | 0.78 | 5 |
| Comparative Example 4 | 1150 | 3000 | 0.76 | 10 |

Further, the magnetic tapes were subjected to 12 cycles of test by the method II-2 in JIS C5024 (test for moisture resistance of electronic parts), and changes on the surface of the tape were examined by means of a microscope. Results are shown in Table 3.

TABLE 3

| | Observation of the surface after testing |
|---|---|
| Example 2 | No change was observed at all. |
| Comparative Example 3 | Slight eruptions (size: several μm-several hundreds μm) were observed. |
| Comparative Example 4 | Generation of eruptions (size: the same as above) and blots were observed. |

Tables 1–3 clearly show that the ferromagnetic metal powders treated with the silane compound of the present invention have an excellent oxidation stability and corrosion resistance and an improved dispersibility, as compared with those treated with other silane compounds and those which are not treated with the silane compound.

EXAMPLES 3 and 4 AND COMPARATIVE EXAMPLES 5 AND 6

Ni-containing α-Fe powder prepared in the same manner as in Example 1 was immersed in toluene containing 2 wt% of a silane compound shown in Table 4 based on the weight of magnetic powder immersed. After being dispersed with stirring, it was filtered out and dried at 40° C. in air to remove toluene. Thus, Ni-containing α-Fe powders were obtained (Samples M-2, M-3, R-3 and R-4).

The magnetostatic characteristics of the thus obtained α-Fe powders and those after being allowed to stand under atmosphere at 60° C. and 90% RH for 1 week are shown in Table 4.

TABLE 4

| | | Magnetostatic Characteristic (Hm = 10 KOe) | | Magnetostatic Characteristic after allowed to stand at 60° C. 90% RH for 1 week | |
|---|---|---|---|---|---|
| Sample | Silane Compound | Hc(Oe) | σs(emu/g) | Hc(Oe) | σs(emu/g) |
| M-2 (Example 3) | Dimethyldimethoxysilane | 1250 | 146 | 1240 | 133 |
| M-3 (Example 4) | Trimethylmethoxysilane | 1250 | 145 | 1240 | 135 |
| R-3 (Comparative Example 5) | Methyltrimethoxysilane | 1240 | 143 | 1220 | 125 |
| R-4 (Compa-Example 6) | Tetramethoxysilane | 1230 | 138 | 1190 | 110 |

EXAMPLES 5 AND 6 AND COMPARATIVE EXAMPLES 7 AND 8

Magnetic tapes were prepared in the same manner as in Example 2, except that the α-Fe powders (M-2, M-3, R-3 and R-4) were used, respectively, instead of the α-Fe powder (M-1).

The magnetostatic characteristics of the thus prepared magnetic tapes and those after being allowed to stand in an atmosphere at 60° C. and 90% RH for 1 week are shown in Table 5.

TABLE 5

| | Ferro-magnetic Metal Powder | Magnetostatic Characteritic (Hm = 10 KOe) Hc | Bm | Squareness Ratio | Reduction Rate of Saturation Flux density (%) |
|---|---|---|---|---|---|
| Example 5 | M-2 | 1150 | 3300 | 0.79 | 2 |
| Example 6 | M-3 | 1150 | 3250 | 0.79 | 2 |
| Comparative Example 7 | R-3 | 1140 | 3200 | 0.77 | 6 |
| Comparative Example 8 | R-4 | 1130 | 3000 | 0.75 | 8 |

Tables 4 and 5 clearly show that the ferromagnetic metal powders treated with the silane compound (n=2 or 3 in the general formula) of the present invention have an excellent oxidation stability and corrosion resistance and an improved dispersibility, as compared with other silane compounds (n=0 or 1).

While the invention has been described in detail and with reference to specific embodiment thereof, it will be apparent to one skilled in the art that various changes and modifications can be made therein without departing from the spirit and scope thereof.

What is claimed is

1. Ferromagnetic metal particles having on the surface thereof a silane compound represented by the general formula:

$$R_n—Si—(OR')_{4-n}$$

wherein R and R' each represent an alkyl group, and n represents 2 or 3.

2. Ferromagnetic metal particles as claimed in claim 1, wherein the alkyl group contains 1 to 20 carbon atoms.

3. Ferromagnetic metal particles as claimed in claim 2, wherein the silane compound is a compound selected from the group consisting of dimethyldimethoxysilane, trimethylmethoxysilane, dimethyldiethoxysilane, trimethylethoxysilane, diethyldiethoxysilane, triethylethoxysilane, bis-(2-chloroethyl)dimethoxysilane and bis-(2-chloroethyl)diethoxysilane.

4. Ferromagnetic metal particles as claimed in claim 2, wherein the ferromagnetic metal particles are comprised of iron.

5. Ferromagnetic metal particles as claimed in claim 2, wherein the ferromagnetic metal particles are comprised of an iron alloy wherein the iron is combined with a metal selected from the group consisting of Ti, V, Cr, Mn, Co, Ni, Cu, Zn, Si, P, Mo, Sn, Sb and Ag.

6. Ferromagnetic metal particles as claimed in claim 2, wherein the silane compound is present in an amount in the range of 0.1 to 20 wt% based on the weight of the ferromagnetic metal particles.

7. Ferromagnetic metal particles as claimed in claim 6, wherein the silane compound is present in an amount in the range of 0.5 to 5 wt% based on the weight of the ferromagnetic metal particles.

* * * * *